US006892694B2

(12) United States Patent
Uchiyama et al.

(10) Patent No.: US 6,892,694 B2
(45) Date of Patent: May 17, 2005

(54) START-UP CONTROL OF DIRECT INJECTION ENGINE

(75) Inventors: Katsuaki Uchiyama, Yokohama (JP); Tsutomu Kikuchi, Tokyo (JP); Yuichi Iriya, Yokohama (JP); Hitoshi Ishii, Yokosuka (JP); Mitsuhiro Akagi, Yokohama (JP); Masahiro Fukuzumi, Machida (JP); Masahiko Yuya, Yokohama (JP); Takao Maitani, Isehara (JP); Masayuki Tomita, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/885,030

(22) Filed: Jul. 7, 2004

(65) Prior Publication Data

US 2005/0005899 A1 Jan. 13, 2005

(30) Foreign Application Priority Data

Jul. 10, 2003 (JP) ..... 2003-194918

(51) Int. Cl.[7] ..... F02B 2/00
(52) U.S. Cl. ..... 123/294; 123/299
(58) Field of Search ..... 123/294, 295, 123/299, 305, 395

(56) References Cited

FOREIGN PATENT DOCUMENTS

JP 2000-145510 A 5/2000

OTHER PUBLICATIONS

U.S. Appl. No. 10/884,975, filed Jul. 7, 2004, Fukuzumi et al.

*Primary Examiner*—Bibhu Mohanty
(74) *Attorney, Agent, or Firm*—Foley & Lardner LLP

(57) ABSTRACT

A start-up control device of a direct injection engine has a fuel injector (76) for injecting fuel into the engine; and a controller. The controller is programmed to determine the presence of a learned value for calculating on the basis thereof a fuel injection amount during start-up of the engine (10) by means of a stratified charge combustion operation; calculate the fuel injection amount on the basis of the learned value when the learned value is present, and control the fuel injector (76) to inject fuel in the compression stroke to start up the engine (10) by means of a stratified charge combustion operation; and control the fuel injector (76) to inject fuel in the intake stroke of the engine to start up the engine by means of a homogeneous combustion operation when the learned value is absent, and obtain and store the learned value during the homogeneous combustion operation of the engine.

12 Claims, 7 Drawing Sheets

START-UP CONTROL OF DIRECT INJECTION ENGINE

TECHNICAL FIELD OF THE INVENTION

This invention relates to a start-up control device and a start-up control method for a direct injection engine.

BACKGROUND OF THE INVENTION

A conventional engine control device switches between homogeneous combustion and stratified charge combustion according to the engine load and engine rotation speed. For example, during the period from the beginning of engine cranking to a certain rise of the engine rotation speed, fuel is injected in the intake stroke such that homogeneous combustion is performed. During a normal operation after the engine is warmed up, stratified charge combustion, in which fuel economy is good, may be performed in a low load region, and high-output homogeneous combustion may be performed in medium and high load regions.

In Tokkai 2000-145510, published in 2000 by Japan Patent Office, when the temperature (water temperature, oil temperature) of the engine is equal to or less than a certain temperature during engine start-up, the air/fuel ratio is set to be lean such that the engine is operated by stratified charge combustion. In so doing, the exhaust gas temperature rises, promoting the activation of a catalyst inside an exhaust gas purification device, and hence the fuel economy is improved and hydrocarbons are reduced.

SUMMARY OF THE INVENTION

Stratified charge combustion is possible when pressure irregularities (pressure variations) within the combustion chamber are below a certain reference point. Referring to FIG. 2, in a state (HOT state) following the end of a warm-up operation when the engine is sufficiently warmed, pressure irregularities are small within a comparatively wide air/fuel ratio range, and hence stratified charge combustion is possible. However, in a state (COLD state) during the warm-up operation in which the engine is not sufficiently warm, the air/fuel ratio range in which stratified charge combustion may be performed is extremely narrow. (It should be noted that the air/fuel ratio range in which stratified charge combustion may be performed in the COLD state is further to the rich side than that of the HOT state.) Hence in a COLD state, it is difficult to generate stratified charge combustion.

An object of this invention is to enable. start-up of a direct injection engine by means of a stratified charge combustion operation even in a COLD state by controlling the air/fuel ratio with a high degree of precision.

In order to achieve the above object, this invention provides a start-up control device of a direct injection engine which performs an intake stroke, a compression stroke, an expansion stroke, and an exhaust stroke in succession. The start-up control device comprises a fuel injector for injecting fuel into the engine; a throttle valve for regulating an intake air flow rate of the engine; a crank angle sensor for detecting a rotational position of a crankshaft of the engine and determining the stroke of the engine; a switch which signals engine start-up; and a controller. The controller receives signals from the crank angle sensor and the switch, and controls the fuel injector. The controller is programmed to determine the presence of a learned value for calculating on the basis thereof a fuel injection amount during start-up of the engine by means of a stratified charge combustion operation; calculate the fuel injection amount on the basis of the learned value when the learned value is present, and control the fuel injector to inject fuel in the compression stroke to start up the engine by means of a stratified charge combustion operation; and control the fuel injector to inject fuel in the intake stroke of the engine to start up the engine by means of a homogeneous combustion operation when the learned value is absent, and obtain and store the learned value during the homogeneous combustion operation of the engine.

The details as well as other features and advantages of this invention are set forth in the remainder of the specification and are shown in the accompanying drawings.

DESCRIPTION OF THE PREFERRED EMBODIMENTS

Figure 1:
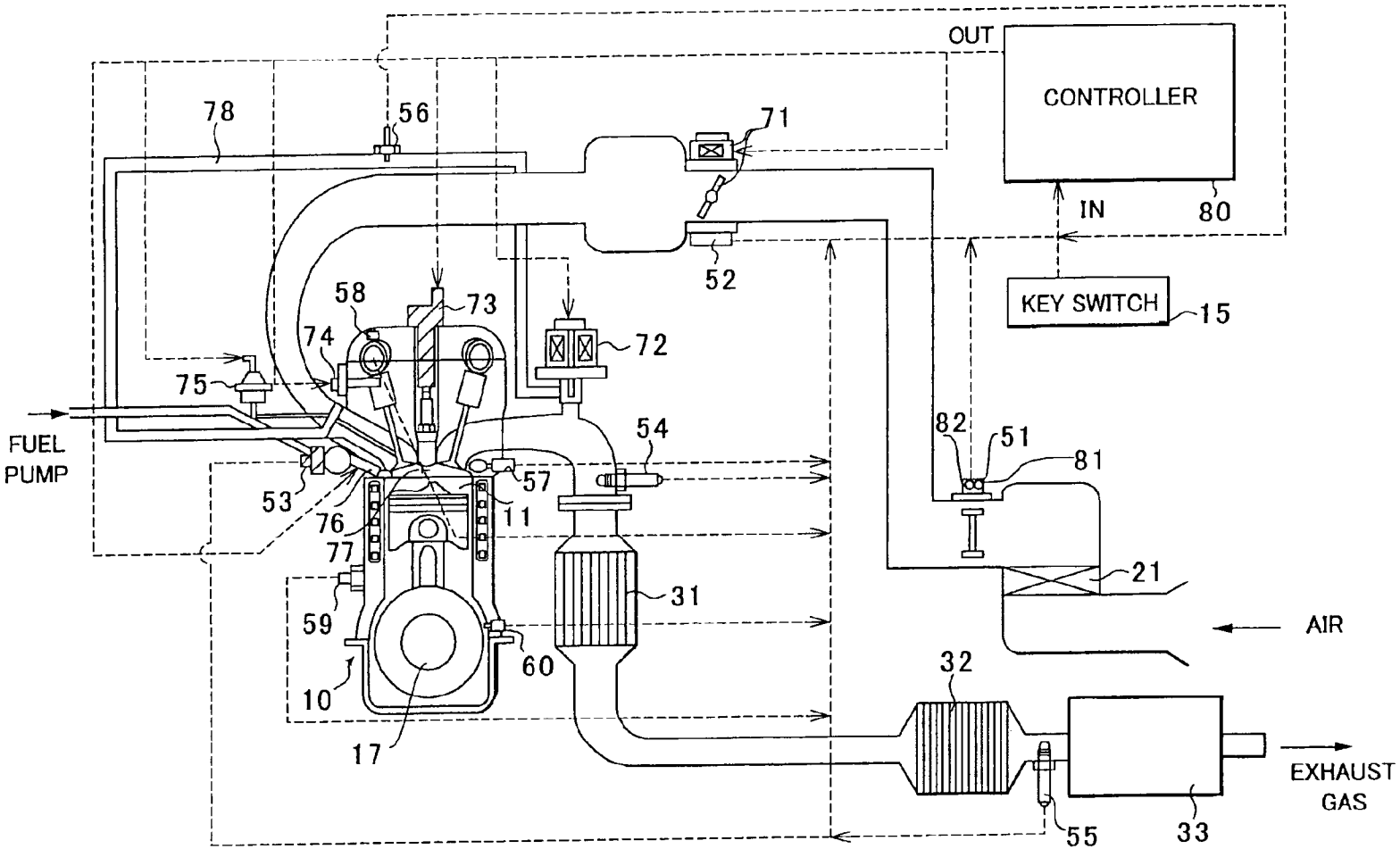
FIG. 1 is a schematic diagram showing an engine system to which this invention is applied and a start-up control device of a direct injection engine according to a first embodiment.

Referring to FIG. 1, a first embodiment will be described.

In an engine system to which this invention is applied, outside air is aspirated into a cylinder 11 of an engine 10 through an air filter 21, an air flow meter 51 and a throttle valve 71. The engine 10 performs an intake stroke, a compression stroke, an expansion stroke, and an exhaust stroke in succession. The engine system is installed in a vehicle. The air flow meter 51 detects the intake air flow rate (intake air amount) of the engine. The throttle valve 71 regulates the intake air flow rate of the engine. The opening of the throttle valve 71 is detected by a throttle opening sensor 52. Fuel delivered from a fuel pump is injected directly into a combustion chamber (or cylinder 11) from a fuel injector 76. The fuel pressure of the fuel injector 76 is detected by a fuel pressure sensor 53. A spark plug 77 ignites the air/fuel mixture inside the combustion chamber such that the air/fuel mixture burns.

Combustion gas is cleaned by three-way catalysts 31, 32 provided at points on an exhaust pipe, and then discharged from a muffler 33. $O_2$ sensors 54, 55 which detect the oxygen concentration of the exhaust gas are attached to the inlet and outlet of the three-way catalysts 31, 32 respectively. A part of the exhaust gas is recirculated to an intake passage through an EGR passage 78. The recirculation rate is regulated by an EGR valve 72. The temperature of the gas that is recirculated to the EGR passage 78 is detected by an EGR temperature sensor 56.

The operating conditions of the engine 10 are detected by a water temperature sensor 57 which detects the water temperature of the engine, a PHASE sensor 58 which detects the rotational position of a camshaft, a knocking sensor 59 which detects engine knocking, and a crank angle sensor 60 which detects the rotational position of a crankshaft 17 of the engine. The crank angle sensor 60 has a function for detecting the engine. rotation speed, and a function for determining the stroke of the engine 10.

The engine system further comprises an engine key switch 15 (ignition switch), an ignition coil 73, a valve timing control (VTC) solenoid valve 74, and an actuator 75. When the engine key switch 15 is in an ON position, fuel ignition is possible, and when the engine key switch 15 is in a START position, a starting switch for a starter motor turns ON, whereby the starter motor (not shown) is rotated.

A controller 80 controls the throttle valve 71, EGR valve 72, ignition coil 73, VTC solenoid valve 74, actuator 75, and fuel injector 76 on the basis of signals from each of the sensors 51–60. The controller 80 also receives a signal indicating the position of the engine key switch 15.

The controller 80 is a microcomputer-based controller. The controller 80 is provided with a microcomputer comprising a central processing unit (CPU) for executing programs, read-only memory (ROM) for storing programs and data, programmable memory (for example, electrically erasable programmable ROM (EEPROM)), random access memory (RAM) for storing calculation results of the CPU and obtained data temporarily, a timer for measuring time, and an input/output interface (I/O interface).

Figure 2:
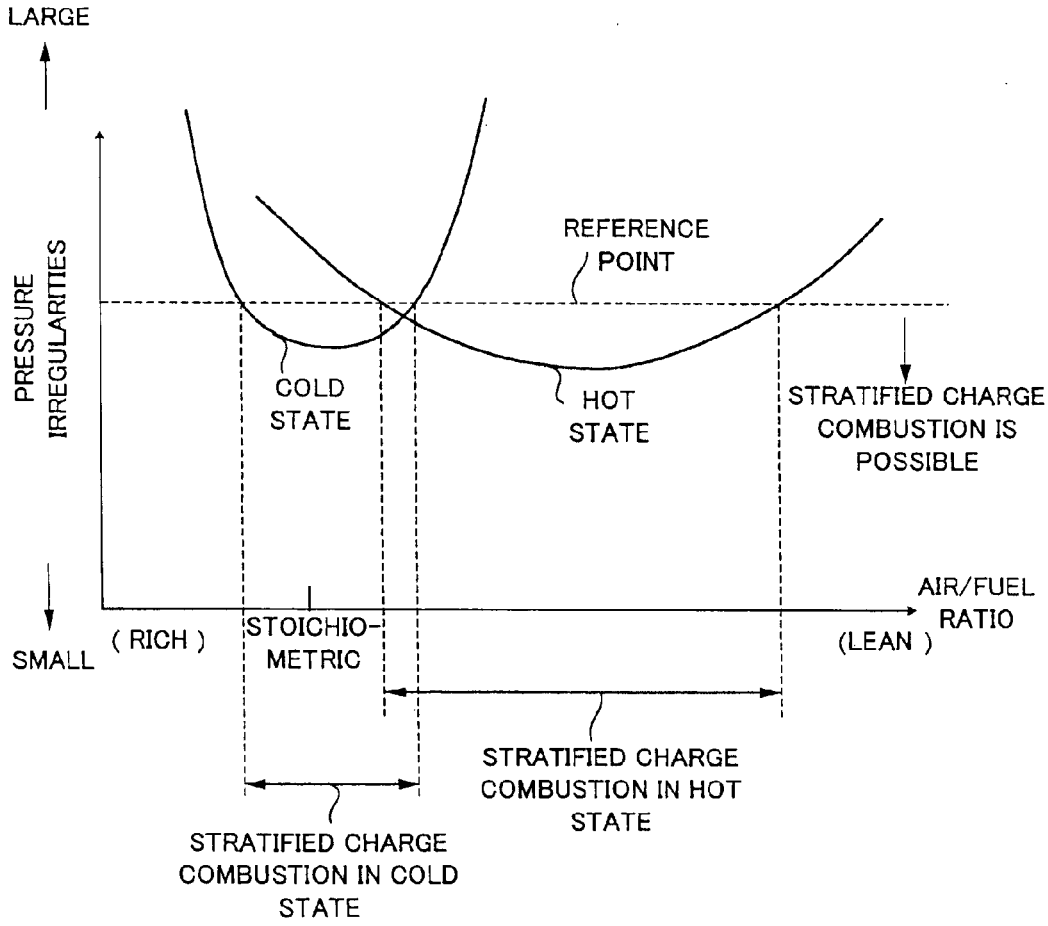
FIG. 2 is a diagram showing a relationship between the air/fuel ratio and pressure irregularities in a combustion chamber during a stratified charge combustion operation.

A summary of the control that is executed by the controller 80 will now be provided. Referring to FIG. 2, to perform stratified charge combustion, which is favorable for reducing exhaust gas emissions, pressure irregularities within the combustion chamber must be suppressed below a certain reference point. In particular, to start the engine using stratified charge combustion in a COLD state when the engine is not sufficiently warm, the controller 80 must control the air/fuel ratio precisely within an extremely narrow range. To do this, the controller 80 learns the air/fuel ratio in order to calculate a fuel injection amount based thereon, and uses the resulting learned value to execute air/fuel ratio control. In other words, the controller 80 executes learning control to obtain an optimum air/fuel ratio.

The air/ fuel ratio range allowing stratified charge combustion differs between the COLD state and HOT state of the engine (see FIG. 2), and moreover, the temperature condition within the combustion chamber, which greatly influences the formation of a fuel spray, is completely different in the COLD and HOT states. Hence, when an attempt is made to perform engine start-up in the COLD state by means of stratified charge combustion using the learned air/fuel ratio value of the HOT state, the difference between the air/fuel ratio range allowing stratified charge combustion in the COLD state and the learned air/fuel ratio value of the HOT state is too great, and therefore engine start-up by means of stratified charge combustion is difficult. The learned air/fuel ratio value allowing stratified charge combustion in the HOT state is considerably greater than the air/fuel ratio allowing stratified charge combustion in the COLD state.

However, the inventors have discovered through experiment that the air/fuel ratio range allowing stratified charge combustion in the COLD state is positioned in the vicinity of the ideal stoichiometric air/fuel ratio (slightly toward the lean side of the ideal stoichiometric air/fuel ratio). Hence the air/fuel ratio range allowing stratified charge combustion in the COLD state is substantially identical to the air/ fuel ratio range of normal homogeneous combustion. Accordingly, the controller 80 learns the air/fuel ratio and intake air amount (from the throttle valve opening, for example) during homogeneous combustion in the engine, and thus enables stratified charge combustion from the time of engine start-up on the basis of the learned air/fuel ratio and intake air amount values.

If the intake air amount during engine start-up by means of stratified charge combustion is set to be substantially fixed such that the controller 80 controls only the fuel injection amount, then only the air/fuel ratio need be learned. If the fuel injection amount during engine start-up by means of stratified charge combustion is set to be substantially fixed such that the controller 80 controls only the intake air amount, then only the intake air amount need be learned.

A start-up control routine for a direct injection engine, which is executed by the controller 80, will now be described. The control routine may be a program (or programs) stored in the memory.

Figure 3:
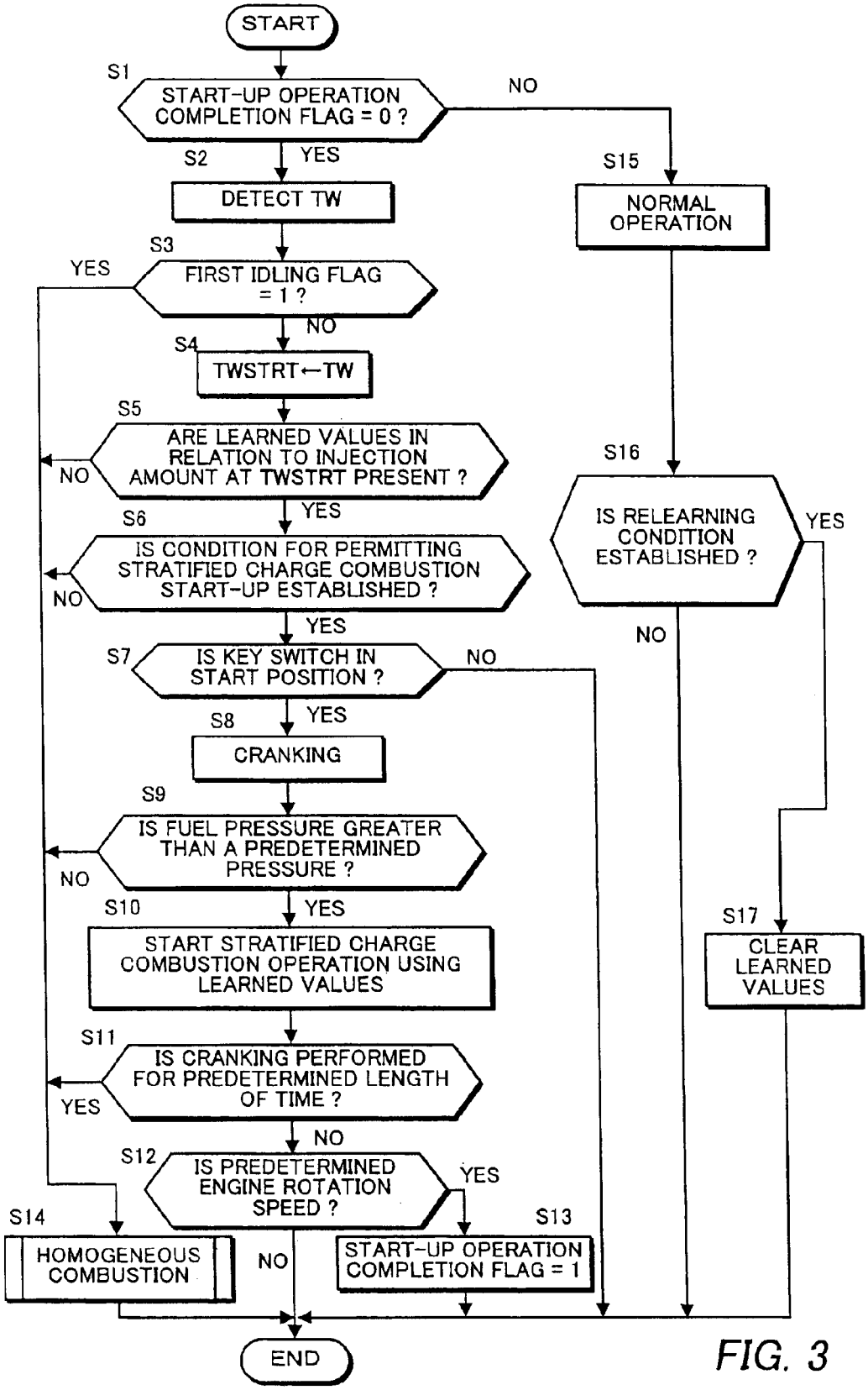
FIG. 3 is a flowchart showing a start-up control routine for the direct injection engine according to the first embodiment.

Referring to FIG. 3, the start-up control routine (main routine) starts when the engine key switch 15 moves to the ON position, and is executed repeatedly thereafter at predetermined time intervals (for example, 10 msec). The engine key switch 15 transmits a signal notifying the controller 80 of the beginning of engine start-up control.

In a step S1, the engine determines whether or not the engine is currently performing a start-up operation. More specifically, when a start-up operation completion flag to be described below is at unity (the initial value thereof being zero), the engine is performing a normal operation and not a start-up operation. If the engine is performing a start-up operation, the routine advances to a step S2.

In the step S2, a water temperature TW of the engine is detected.

Next, in a step S3, a determination is made as to whether or not a first idling flag is at unity. The initial value of this first idling flag is zero, and when the first idling flag is at zero, the routine advances to a step S4. When the first idling flag is at unity, the routine advances to a step S14 where homogeneous combustion start-up control is executed to start-up the engine. In other words, the engine is controlled such that the start-up operation is performed by means of homogeneous combustion. In homogeneous combustion start-up control, the air/fuel ratio and intake air amount (the throttle valve opening, for example) are learned. Homogeneous combustion start-up control will be described hereinafter.

In the step S4, a pre-start-up water temperature TWSTRT is set as the water temperature TW.

Figure 4:
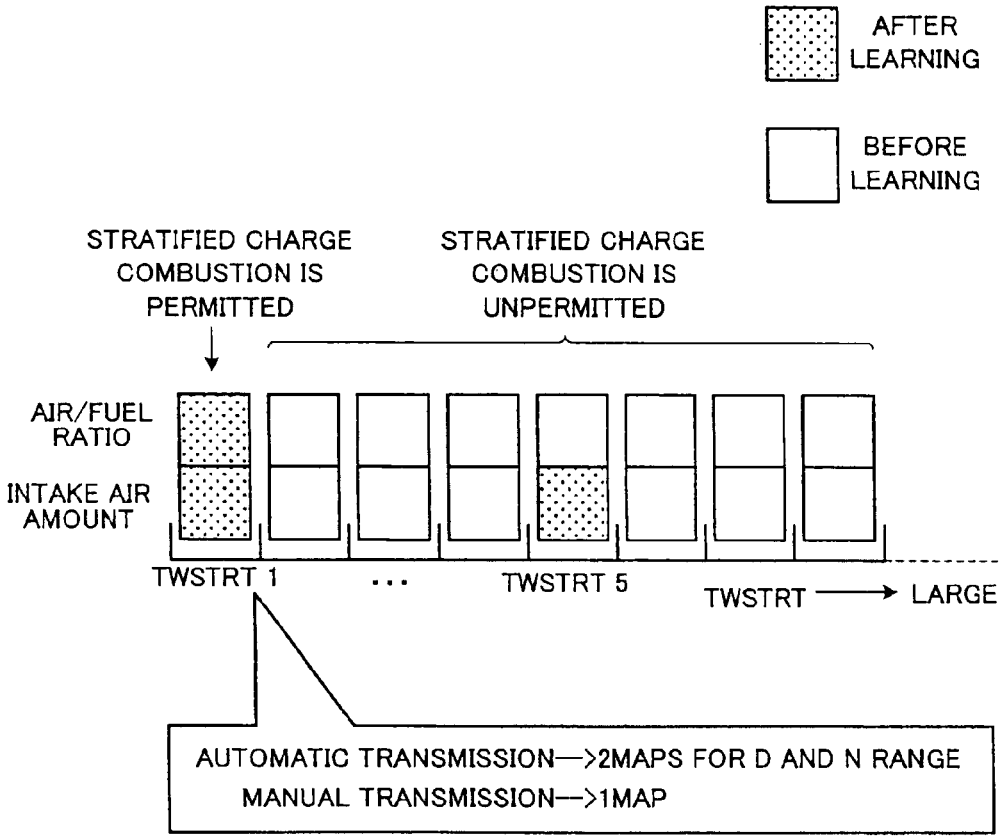
FIG. 4 is a diagram illustrating a learning process of the first embodiment.

Next, in a step S5, a determination is made as to whether or not learning in a COLD state has been performed at the pre-start-up water temperature TWSTRT. In other words, a determination is made on the basis of a flag FLG as to whether or not learned values for the air/fuel ratio and intake air amount at the water temperature TWSTRT are present in the programmable memory. Learning in a COLD state indicates learning of the air/fuel ratio and intake air amount at low temperatures. Once both the air/fuel ratio and the intake air amount have been learned at the water temperature TWSTRT, the routine advances to a step S6. If one of the air/fuel ratio and intake air amount has not been learned, stratified charge combustion is difficult to realize, and hence the routine advances to the step S14, where homogeneous combustion start-up control of the engine is performed. Hence, as shown in FIG. 4, if learned values for both the air/fuel ratio and the intake air amount are obtained at the pre-start-up water temperature TWSTRT, engine start-up by stratified charge combustion is permitted, whereas if one of the learned values is not obtained, engine start-up by stratified charge combustion is prohibited. During the first execution of the start-up control routine, learning in a COLD state is not complete, and hence the routine advances to the step S14.

Figure 5:
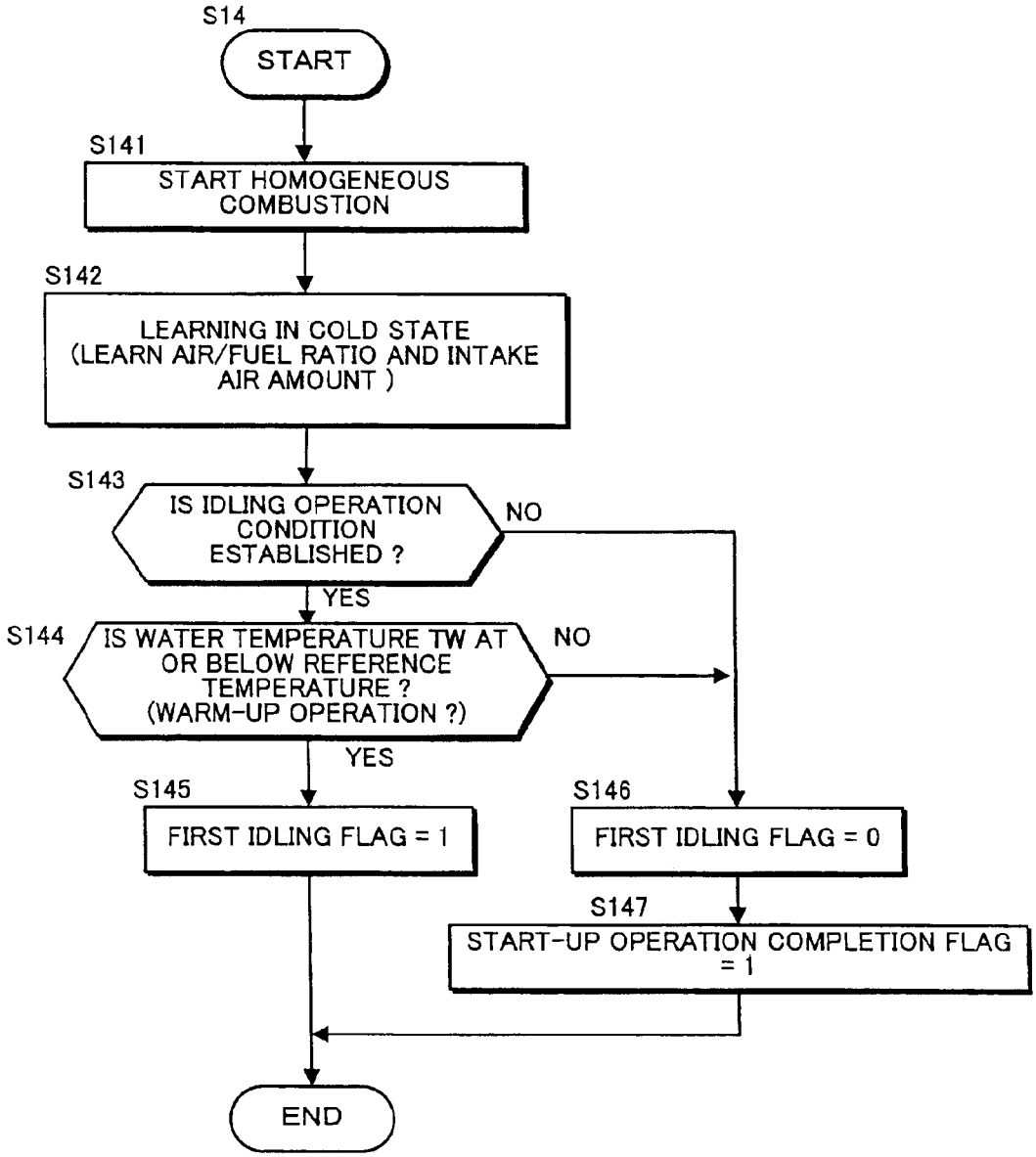
FIG. 5 is a flowchart illustrating a subroutine for homogeneous combustion control.

Referring to FIGS. 4, 5, the processing of the step S14 will be described. FIG. 5 is a flowchart illustrating a subroutine for homogeneous combustion start-up control of the engine.

In a step S141, fuel is injected in the intake stroke, causing the engine start-up operation to be performed by homogeneous combustion. (When engine cranking has not yet been performed, the subroutine may return to the main routine.)

In a step S142, learning in a COLD state (learning of the air/fuel ratio and intake air amount at low temperatures) is performed. When learning of both the air/fuel ratio and the intake air amount is complete, the flag FLG is set to unity. The reason for learning both the air/fuel ratio and the intake air amount is to control both the amount of fuel and the amount of intake air that are required to obtain the target output of the engine. Hence not only the air/fuel ratio, but also the intake air amount is learned. The learned values are stored in the programmable memory of the controller together with the detected water temperature TW, and a map which provides the air/fuel ratio and air amount (or a data set (table) of the detected water temperature TW and the learned values) is created.

In the case of an automatic transmission vehicle, two maps (an N range map and a D range map) are stored in the memory in accordance with load differences, or in other words the difference between the N range and the D range. In the case of a manual transmission vehicle, a single map is stored (see FIG. 4).

In a step S143, a determination is made as to whether or not an idling operation condition of the engine has been established. For example, if the opening of the throttle valve 71 is near zero or if an idling switch is placed at an ON position, then it is determined that the idling operation condition is established. Otherwise, the determination may be made based on the engine rotation speed and the fuel injection amount. If an idling operation state of the engine has been established, or in other words if an idling operation is underway in the engine, the routine advances to a step S144.

In the step S144, a determination is made as to whether or not the engine is performing a warm-up operation, or more specifically, whether or not the water temperature TW is at or below a reference temperature e.g. 80° C. If the water temperature TW is at or below the reference temperature, and hence the warm-up operation is not complete, the routine advances to a step S145, where the first idling flag is set to unity. The first idling flag indicates that the engine is in an idling operation state and warm-up is underway. It should be noted that the initial value of the first idling flag is zero.

When the operational state of the engine indicates a normal operation (when a negative determination is obtained in the step S143) in which the idling operation condition is not established, or when the water temperature TW is greater than the reference temperature, thus indicating that the warm-up operation is complete (when a negative determination is obtained in the step S144), the routine advances to a step S146. In the step S146, the first idling flag is set to zero. Then, in a step S147, a start-up operation completion flag indicating the end of a start-up operation of the engine is set to unity.

Referring back to FIG. 3, when the engine has been started by a homogeneous combustion operation, the first idling flag is set to unity, and hence the process (step S1→step S2→step S3→estep S14) is executed repeatedly until the water temperature TW exceeds the reference temperature. As this process is repeated, the engine is warmed by the homogeneous combustion operation, and the air-fuel ratio and intake air amount are learned for each detected water temperature TW (and stored in the programmable memory).

Since the initial value of the first idling flag is zero, when the next start-up operation of the engine begins (when the engine key switch is turned ON), the routine first advances through the steps S1, S2, S3, and S4 in succession. Then, if it is determined that learning in the COLD state is complete at the pre-start-up water temperature TWSTRT in the step S5, the routine advances to the step S6.

In the step S6, a determination is made as to whether or not a condition for permitting stratified charge combustion start-up has been established. More specifically, the determination may be made on the basis of an intake air temperature sensor 81 and an atmospheric pressure sensor 82 (both of which are provided on the air flow meter 51). The determination may be also made on the basis of a fault diagnosis (for example, the existence of disconnected wires or information regarding the determination of a fault during a previous operation) in these sensors, the air flow meter 51, an air motion device, and so on. The air motion device is a device for generating a swirl flow or tumble flow in the cylinder 11 e.g. a swirl control valve or tumble control valve of the engine. Usually, the condition for permitting stratified charge combustion start-up is established at this time. However, when the intake air temperature is less than a predetermined low value, when the atmospheric pressure is less than a predetermined low value, or when a fault is detected in the fault diagnosis, it is determined that the condition for permitting stratified charge combustion start-up has not been established.

In a step S7, a determination is made as to whether or not the engine key switch 15 is in the START position. If the ignition switch is in the START position, the routine advances to a step S8.

In the step S8, engine cranking is performed by the starter motor. During cranking, a signal indicating that the starter motor is operative is input into the controller 80 from the starting switch for the starter motor.

In a step S9, a determination is made as to whether or not the fuel pressure is greater than a predetermined pressure. During a stratified charge combustion operation of the engine, fuel is injected in the compression stroke, and hence if the fuel pressure is low, fuel cannot be injected. Thus, in the step S9 a determination is made as to whether or not the fuel pressure is larger than a predetermined pressure above which fuel can be injected. The predetermined pressure may be the order of several megapascals (MPa) and may be set according to the engine rotation speed or fuel injection amount. If the fuel pressure is lower than the predetermined pressure, the routine advances to the step S14, where homogeneous combustion start-up control is performed. If the fuel pressure is greater than the predetermined pressure, the routine advances to a step S10.

In the step S10, the learned air/fuel ratio value and the learned intake air amount value stored previously in the step S142 are used to start a stratified charge combustion operation. In other words, the controller 80 sets a target air/fuel ratio to the learned air/fuel ratio value, calculates a target fuel injection amount from the learned air intake amount value and the target air/fuel ratio, and controls the fuel injector 76 to inject the target fuel injection amount.

In a step S11, a determination is made on the basis of the signal indicating that the starter motor is operative as to whether or not the starter motor has continued cranking for a predetermined length of time or more. The predetermined length of time may be set to decrease according to the pre-start-up water temperature TWSTRT or the rotation speed of the starter motor. When cranking has continued for the predetermined length of time, the routine advances to the step S14, where processing for homogeneous combustion start-up is performed. At this time, in spite of cranking for the predetermined length of time, the engine rotation speed has not yet reached a minimum rotation speed enabling complete combustion of the fuel, and hence the engine is in a state in which misfires can occur and stratified charge combustion is difficult.

In the step S12, a determination is made as to whether or not the engine rotation speed exceeds a predetermined rotation speed (=a minimum rotation speed enabling complete combustion of the fuel, e.g. 300–800 rpm). The processing of the steps S1–S12 is executed repeatedly until the engine rotation speed exceeds the predetermined rotation speed.

Once the engine rotation speed has exceeded the predetermined rotation speed (when the determination in the step S12 is positive), the routine advances to a step S13, where the start-up operation completion flag is set to unity.

Thereafter, the start-up operation completion flag is at unity, and hence when the control routine is repeated, the routine advances from the step S1 to a step S15. In the step S15, the engine performs a normal operation. As described above, in a normal operation of the engine, combustion control in the engine is switched according to the operating conditions. In other words, in a low load region, fuel is injected in the compression stroke to improve the fuel economy, and hence stratified charge combustion is performed. In medium and high load regions, fuel is injected in the intake stroke to improve the engine output, and hence homogeneous combustion is performed.

Next, in a step S16, a determination is made on the basis of the operating history as to whether or not a relearning condition has been established. When the relearning condition is established, the routine advances to a step S17, where all of the learned values learned in the COLD state are cleared from the programmable memory. In so doing, the learned values in the COLD state can be updated in the step S142 according to temporal deterioration of the components, and hence stratified charge combustion start-up can be performed. For example, the relearning condition is (1) the detection of a deviation in the learned values in the HOT state, (2) the occurrence of a deviation in the torque that is transmitted to the crankshaft 17 when switching from stratified charge combustion start-up to homogeneous combustion start-up, (3) the elapse of a reference time period, (4) the elapse of a reference distance traveled, or (5) a reference number of engine start-ups after the learned values in the COLD state are cleared.

Next, the effects of the first embodiment will be described.

For smooth stratified charge combustion, pressure irregularities inside the combustion chamber must be suppressed to or below a certain reference point. In particular, the air/fuel ratio must be controlled with great precision in order to perform start-up by stratified charge combustion in a COLD state when the engine is not sufficiently warm (see FIG. 2). Hence the controller learns the air/fuel ratio, and uses the learned value thereof to operate the engine.

The air/fuel ratio range in which stratified charge combustion is possible in a COLD state is near the ideal stoichiometric air/fuel ratio, which is substantially identical to the air/fuel ratio at which homogeneous combustion is performed. In this embodiment, the air/fuel ratio and intake air amount are learned during homogeneous combustion in the engine, and the air/fuel ratio is controlled to the resulting learned values. In so doing, stratified charge combustion can be realized during a cold start of the engine. By performing stratified charge combustion from the beginning of start-up, the fuel economy is improved, and hence excessive fuel consumption is prevented. Moreover, hydrocarbon discharge due to surplus fuel during engine start-up is reduced.

Further, when a relearning condition is established, all of the learned values of the COLD state are cleared, and hence stratified charge combustion start-up can be performed in spite of temporal deterioration of the components.

Figure 6:
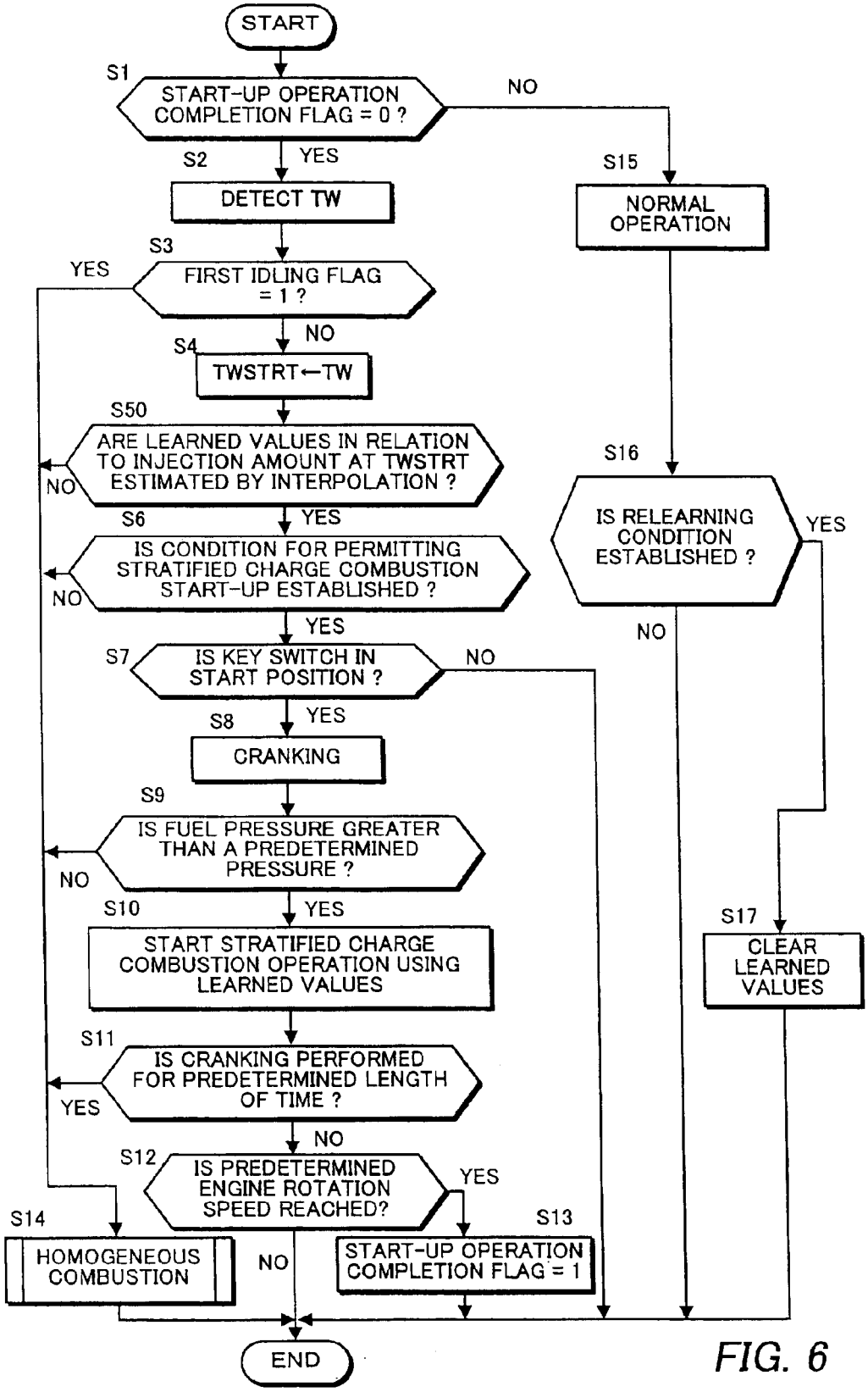
FIG. 6 is a flowchart showing a start-up control routine for a direct injection engine according to a second embodiment.

Next, referring to the flowchart in FIG. 6, a second embodiment will be described. In the flowchart in FIG. 6, identical reference symbols have been allocated to parts having identical functions to the first embodiment, and description thereof has been omitted.

In the first embodiment, a learned air/fuel ratio value and a learned intake air amount value are stored for each temperature (step S142), and the existence of COLD state learned values within the memory is determined for each pre-start-up water temperature TWSTRT (step S5).

In the second embodiment, however, a function (interpolation formula) for deriving the learned values (the learned air/fuel ratio value and the learned intake air amount value) is determined on the basis of several data sets comprising pre-start-up water temperatures TWSTRT and COLD state learned values. From this function, learned values are derived for the other water temperatures TWSTRT which do not possess a learned value (step S50). If the number of data sets is insufficient such that an interpolation formula cannot be created, the routine advances to the step S14, where the engine is operated by homogeneous combustion. When it is possible to create an interpolation formula, the routine advances to the step S6.

Figure 7:
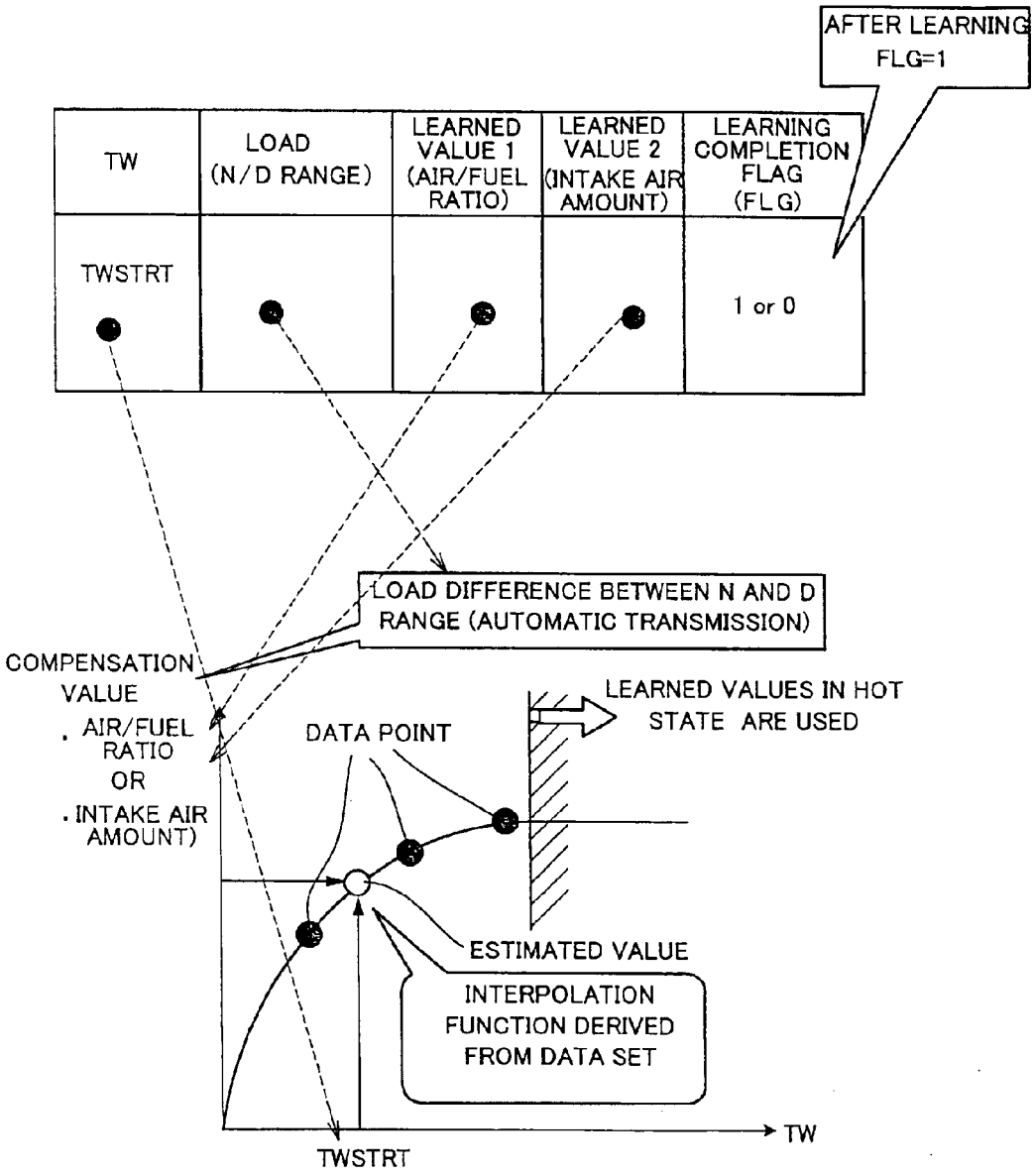
FIG. 7 is a diagram illustrating a learning process of the second embodiment.

In other words, as shown in FIG. 7, an interpolation function is calculated on the basis of several data sets of the detected water temperature TW and the learned values, whereupon the learned values of the other water temperatures TWSTRT not corresponding to the previously detected water temperature TW are determined from the interpolation function. In so doing, stratified charge combustion start-up can be begun without spending time on learning the air/fuel ratio and intake air amount.

The entire contents of Japanese Patent Application P2003-194918 (filed Jul. 10, 2004) are incorporated herein by reference.

Although the invention has been described above by reference to a certain embodiment of the invention, the invention is not limited to the embodiment described above. Modifications and variations of the embodiment described above will occur to those skilled in the art, in light of the above teachings. The scope of the invention is defined with reference to the following claims.

What is claimed is:

1. A start-up control device of a direct injection engine which performs an intake stroke, a compression stroke, an expansion stroke, and an exhaust stroke in succession, comprising:

a fuel injector for injecting fuel into the engine;

a throttle valve for regulating an intake air flow rate of the engine;

a crank angle sensor for detecting a rotational position of a crankshaft of the engine and determining the stroke of the engine;

a switch which signals engine start-up; and a controller which receives signals from the crank angle sensor and the switch, and controls the fuel injector, wherein the controller is programmed to:

determine the presence of a learned value for calculating on the basis thereof a fuel injection amount during start-up of the engine by means of a stratified charge combustion operation;

calculate the fuel injection amount on the basis of the learned value when the learned value is present, and control the fuel injector to inject fuel in the compression stroke to start up the engine by means of a stratified charge combustion operation; and control the fuel injector to inject fuel in the intake stroke of the engine to start up the engine by means of a homogeneous combustion operation when the learned value is absent, and obtain and store the learned value during the homogeneous combustion operation of the engine.

2. The start-up control device as defined in claim 1, wherein the learned value is at least one of a learned air/fuel ratio value and a learned engine intake air amount value.

3. The start-up control device as defined in claim 1, comprising a temperature sensor which detects an engine water temperature, wherein the controller is programmed to obtain a learned value for each detected engine water temperature during the homogeneous combustion operation of the engine, and store a data set comprising the detected engine water temperature and the obtained learned value.

4. The start-up control device as defined in claim 3, wherein the controller is programmed to detect the engine water temperature upon reception of a signal from the switch notifying engine start-up, and determine the presence of a learned value relating to the detected engine water temperature.

5. The start-up control device as defined in claim 3, wherein the controller is programmed to estimate the learned value on the basis of an interpolation function obtained from the data set.

6. The start-up control device as defined in claim 1, wherein the controller is programmed to determine whether or not a relearning condition has been established on the basis of an operating history, and clear the stored learned values when the relearning condition has been established.

7. The start-up control device as defined in claim 1, wherein the controller is programmed to determine whether or not a condition permitting stratified charge combustion start-up has been established, and control the fuel injector to start up the engine by means of a homogeneous combustion operation when the condition has not been established.

8. The start-up control device as defined in claim 1, wherein the controller is programmed to determine whether or not a fuel pressure is greater than a predetermined pressure, and control the fuel injector to start up the engine by means of a homogeneous combustion operation when the fuel pressure is not greater than the predetermined pressure.

9. The start-up control device as defined in claim 1, further comprising a starter motor which performs engine cranking, and a starting switch which transmits to the controller a signal indicating that the starter motor is operative, wherein the controller is programmed to:

determine whether or not the starter motor has continued cranking for a predetermined length of time or more on the basis of the signal indicating that the starter motor is operative; and control the fuel injector to start up the engine by means of a homogeneous combustion operation when the starter motor has continued cranking for the predetermined length of time or more.

10. The start-up control device as defined in claim 1, wherein the controller is programmed to:

obtain an engine rotation speed from a signal from the crank angle sensor;

determine whether or not the engine rotation speed exceeds a predetermined rotation speed; and perform control such that a normal operation is performed in the engine when the engine rotation speed exceeds the predetermined rotation speed.

11. A start-up control device of a direct injection engine which performs an intake stroke, a compression stroke, an expansion stroke, and an exhaust stroke in succession, comprising:

means for injecting fuel into the engine;

means for regulating an intake air flow rate of the engine;

means for detecting a rotational position of a crankshaft of the engine and determining the stroke of the engine;

means for signaling engine start-up;

means for determining the presence of a learned value for calculating on the basis thereof a fuel injection amount during start-up of the engine by means of a stratified charge combustion operation;

means for calculating the fuel injection amount on the basis of the learned value when the learned value is present, and controlling the fuel injector to inject fuel in the compression stroke to start up the engine by means of a stratified charge combustion operation; and means for controlling the fuel injector to inject fuel in the intake stroke of the engine to start up the engine by means of a homogeneous combustion operation when the learned value is absent, and obtaining and storing the learned value during the homogeneous combustion operation of the engine.

12. A start-up control method of a direct injection engine which performs an intake stroke, a compression stroke, an expansion stroke, and an exhaust stroke in succession; the engine comprising a fuel injector for injecting fuel into the engine; a throttle valve for regulating an intake air flow rate of the engine; a crank angle sensor for detecting a rotational position of a crankshaft of the engine and determining the stroke of the engine, comprising the steps of:

signaling engine start-up;

determining the presence of a learned value for calculating on the basis thereof a fuel injection amount during start-up of the engine by means of a stratified charge combustion operation;

calculating the fuel injection amount on the basis of the learned value when the learned value is present, and subsequently controlling the fuel injector to inject fuel in the compression stroke to start up the engine by means of a stratified charge combustion operation; and controlling the fuel injector to inject fuel in the intake stroke of the engine to start up the engine by means of a homogeneous combustion operation when the learned value is absent; and obtaining and storing the learned value during the homogeneous combustion operation of the engine.

* * * * *